US011550240B2

(12) United States Patent
Inoue

(10) Patent No.: US 11,550,240 B2
(45) Date of Patent: Jan. 10, 2023

(54) DEVELOPING DEVICE CAPABLE OF DETECTING STORAGE AMOUNT OF DEVELOPER, IMAGE FORMING APPARATUS, AND DEVELOPER DETECTION METHOD

(71) Applicant: KYOCERA Document Solutions Inc., Osaka (JP)

(72) Inventor: Takashi Inoue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/648,092

(22) Filed: Jan. 14, 2022

(65) Prior Publication Data

US 2022/0229382 A1 Jul. 21, 2022

(30) Foreign Application Priority Data

Jan. 18, 2021 (JP) ..... JP2021-005653

(51) Int. Cl.
*G03G 15/08* (2006.01)
*G03G 15/10* (2006.01)

(52) U.S. Cl.
CPC ..... *G03G 15/0891* (2013.01); *G03G 15/086* (2013.01); *G03G 15/0853* (2013.01); (Continued)

(58) Field of Classification Search
CPC ..... G03G 15/0891; G03G 15/0853; G03G 15/0889; G03G 15/0893; G03G 15/086; (Continued)

(56) References Cited

U.S. PATENT DOCUMENTS 5,353,103 A * 10/1994 Okamoto ..... G03G 15/0126 399/63
2006/0193650 A1 8/2006 Takenouchi et al.
(Continued)

FOREIGN PATENT DOCUMENTS

JP 2006268034 A 10/2006

*Primary Examiner* — Arlene Heredia
*Assistant Examiner* — Laura Roth
(74) *Attorney, Agent, or Firm* — Alleman Hall Creasman & Tuttle LLP

(57) ABSTRACT

A developing device includes a storage portion storing a developer, a conveying portion stirring and conveying the developer in the storage portion, a sensor, an acquisition processing portion, and a correction processing portion. The sensor outputs an electrical signal in accordance with magnetic permeability at a predetermined detection position in a conveyance path of the developer. The acquisition processing portion acquires a specific value based on the electrical signal outputted during a rotation period of the conveying portion. The correction processing portion corrects the specific value based on a rotation speed of the conveying portion when a fluctuation width of the electrical signal outputted during the rotation period of the conveying portion is less than a predetermined threshold, and corrects the specific value based on the rotation speed of the conveying portion and the fluctuation width when the fluctuation width is equal to or greater than the threshold.

6 Claims, 7 Drawing Sheets

(52) U.S. Cl.
CPC ..... *G03G 15/0889* (2013.01); *G03G 15/105* (2013.01); *G03G 2215/0888* (2013.01)

(58) Field of Classification Search
CPC ..... G03G 15/105; G03G 2215/0888; G03G 15/0877; G03G 15/0822
See application file for complete search history.

(56) References Cited

U.S. PATENT DOCUMENTS

| | | | | |
|---|---|---|---|---|
| 2012/0008969 | A1* | 1/2012 | Mitamura ..... | G03G 15/0891 399/53 |
| 2012/0207490 | A1* | 8/2012 | Itoyama ..... | G03G 15/0893 399/27 |

* cited by examiner

DEVELOPING DEVICE CAPABLE OF DETECTING STORAGE AMOUNT OF DEVELOPER, IMAGE FORMING APPARATUS, AND DEVELOPER DETECTION METHOD

INCORPORATION BY REFERENCE

This application is based upon and claims the benefit of priority from the corresponding Japanese Patent Application No. 2021-005653 filed on Jan. 18, 2021, the entire contents of which are incorporated herein by reference.

BACKGROUND

The present disclosure relates to a developing device, an image forming apparatus, and a developer detection method.

An electrophotographic image forming apparatus includes a developing device configured to develop an electrostatic latent image that is formed on an image-carrying member such as a photoconductor drum. The developing device includes a storage portion that stores a developer such as a toner. The developing device develops the electrostatic latent image using the developer stored in the storage portion.

For example, the storage portion of this type of developing device stores two-component developer containing non-magnetic developer and magnetic carrier. In addition, the storage portion has a conveying portion and a sensor. The conveying portion is rotatably provided in the storage portion, and conveys the developer and the carrier while stirring the developer and the carrier. The sensor outputs an electrical signal in accordance with permeability at a predetermined detection position in a conveyance path of the developer and the carrier that are conveyed by the conveying portion. The sensor is used for detecting a storage amount of the developer of the storage portion.

When a rotation speed of the conveying portion increases, an amount of the carrier scooped by the conveying portion increases, thereby causing density of the carrier at the detection position to decrease. Accordingly, an output of the sensor changes regardless of whether the storage amount of the developer in the storage portion changes. Therefore, in a configuration in which the rotation speed of the conveying portion can be changed, detection accuracy of the storage amount of the developer in the storage portion decreases. To overcome this problem, an image forming apparatus that corrects an output value of the sensor based on the rotation speed of the conveying portion has been known, focusing on a fact that there is a relationship that can be expressed by a linear expression between the rotation speed of the conveying portion and the output value of the sensor.

SUMMARY

A developing device according to one aspect of the present disclosure includes a storage portion, a conveying portion, a sensor, an acquisition processing portion, and a correction processing portion. The storage portion stores a developer. The conveying portion is rotatably provided in the storage portion, and stirs and conveys the developer within the storage portion. The sensor outputs an electrical signal in accordance with magnetic permeability at a predetermined detection position in a conveyance path of the developer conveyed by the conveying portion. The acquisition processing portion acquires a specific value based on the electrical signal outputted during a rotation period of the conveying portion. The correction processing portion corrects the specific value based on a rotation speed of the conveying portion when a fluctuation width of the electrical signal outputted during the rotation period of the conveying portion is less than a predetermined threshold, and corrects the specific value based on the rotation speed of the conveying portion and the fluctuation width when the fluctuation width is equal to or greater than the threshold.

An image forming apparatus according to another aspect of the present disclosure includes the developing device.

In a developer detection method executed in a developing device, the developing device including a storage portion that stores a developer, a conveying portion that is rotatably provided in the storage portion and stirs and conveys the developer in the storage portion, and a sensor configured to output an electrical signal in accordance with magnetic permeability at a predetermined detection position in a conveyance path of the developer conveyed by the conveying portion, the developer detection method includes an acquisition step and a correction step. The acquisition step is to acquire a specific value based on the electrical signal outputted during a rotation period of the conveying portion. The correction step is to correct the specific value based on a rotation speed of the conveying portion when a fluctuation width of the electrical signal outputted during the rotation period of the conveying portion is less than a predetermined threshold, and to correct the specific value based on the rotation speed of the conveying portion and the fluctuation width when the fluctuation width is equal to or greater than the threshold.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

Configuration of Image Forming Apparatus 100

Firstly, a description will be given of a configuration of an image forming apparatus 100 according to the embodiment of the present disclosure with reference to FIGS. 1 and 2. Here, FIG. 1 illustrates a cross-sectional view of the configuration of the image forming apparatus 100.

For convenience of explanation, in an installation state where the image forming apparatus 100 is usable (a state illustrated in FIG. 1), a vertical direction is defined as an up-down direction D1. A front-rear direction D2 is defined having a surface of the image forming apparatus 100 illustrated in FIG. 1 on a paper left side as a front (front face). A left-right direction D3 is defined having the front of the image forming apparatus 100 in the installation state as a reference.

The image forming apparatus 100 is a multifunctional peripheral that has a plurality of functions such as a facsimile function and a copy function in addition to a scan function that scans image data from an original document and a print function that forms an image based on the image data. The image forming apparatus 100 may be a printer device, a facsimile device, a copier, or the like.

Figure 1:
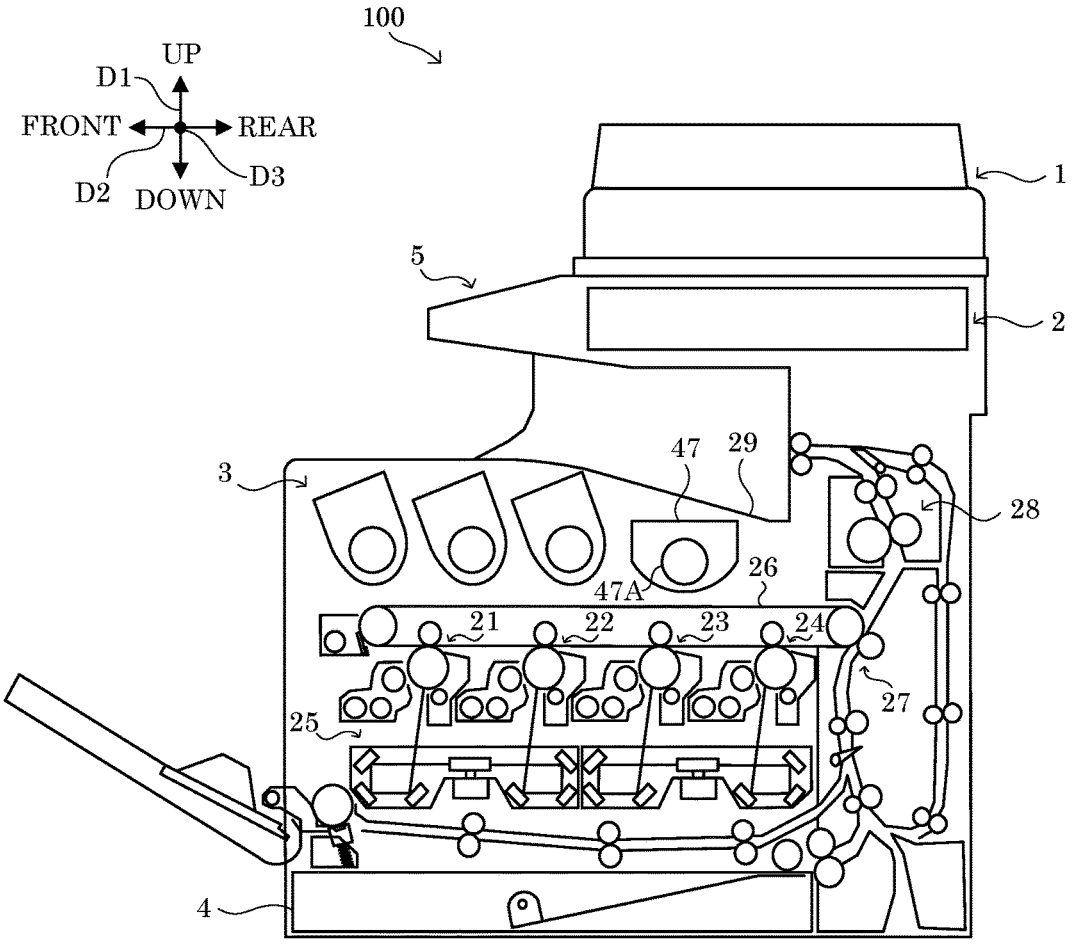
FIG. 1 is a drawing illustrating a configuration of an image forming apparatus according to an embodiment of the present disclosure.
Figure 2:
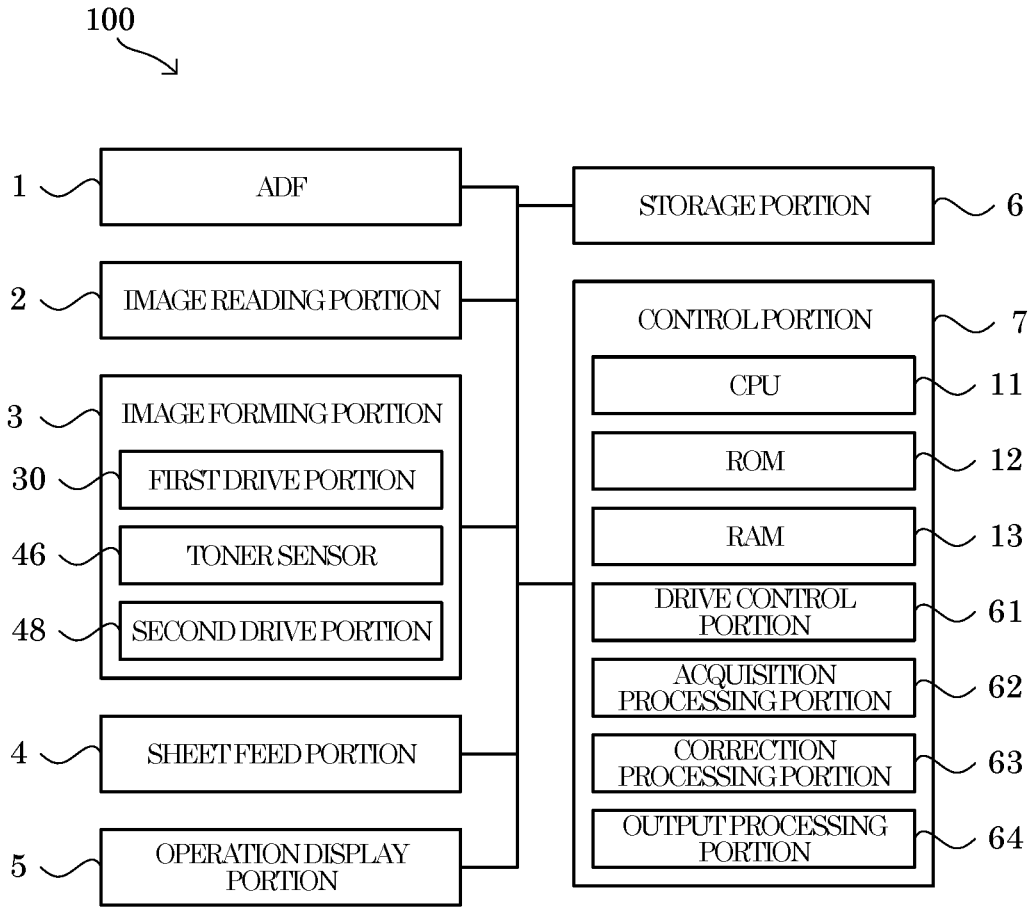
FIG. 2 is a block diagram illustrating a system configuration of the image forming apparatus according to the embodiment of the present disclosure.

As illustrated in FIG. 1 and FIG. 2, the image forming apparatus 100 includes an ADF (Auto Document Feeder) 1, an image reading portion 2, an image forming portion 3, a sheet feed portion 4, an operation display portion 5, a storage portion 6, and a control portion 7.

The ADF 1 conveys the original document to be read by the scan function. The ADF 1 includes a document sheet setting portion, a plurality of conveying rollers, a document sheet holder, and a sheet discharge portion.

The image reading portion 2 implements the scan function. The image reading portion 2 includes a document sheet table, a light source, a plurality of mirrors, an optical lens, and a CCD (Charge Coupled Device).

The image forming portion 3 implements the print function. Specifically, the image forming portion 3 forms a color image or a monochrome image on a sheet supplied from the sheet feed portion 4 by using an electrophotographic method.

The sheet feed portion 4 supplies the sheet to the image forming portion 3. The sheet feed portion 4 includes a sheet feed cassette, a manual feed tray, a sheet conveyance path, and a plurality of conveying rollers.

The operation display portion 5 is a user interface of the image forming apparatus 100. The operation display portion 5 includes a display portion such as a liquid crystal display and an operation portion such as operation keys or a touch panel. The display portion displays thereon various kinds of information in response to a control instruction from the control portion 7. The operation portion inputs various kinds of information into the control portion 7 in response to user's operation.

The storage portion 6 is a non-volatile storage device. For example, the storage portion 6 may be a storage device including a non-volatile memory such as a flash memory and EEPROM, SSD (Solid State Drive) or HDD (Hard Disk Drive).

The control portion 7 comprehensively controls the image forming apparatus 100. As illustrated in FIG. 2, the control portion 7 includes a CPU 11, a ROM 12, and a RAM 13. The CPU 11 is a processor that executes various calculation processes. The ROM 12 is a non-volatile storage device that preliminarily stores information such as a control program to cause the CPU 11 to execute various processes. The RAM 13 is a volatile or non-volatile storage device and is used as a temporary memory (work area) of the various processes executed by the CPU 11. In the control portion 7, the CPU 11 executes the various control programs preliminarily stored in the ROM 12. Accordingly, the image forming apparatus 100 is comprehensively controlled by the control portion 7.

The control portion 7 may include an electronic circuit such as an integrated circuit (ASIC), or may be a control portion provided separately from a main control portion that integrally controls the image forming apparatus 100.

Configuration of Image Forming Portion 3

Next, a configuration of the image forming portion 3 will be described with reference to FIGS. 1 to 3. Here, FIG. 3 illustrates a cross-sectional view of the configuration of an image forming unit 24.

As illustrated in FIG. 1, the image forming portion 3 includes four image forming units 21 to 24, a laser scanning unit 25, an intermediate transfer belt 26, a secondary transfer roller 27, a fixing device 28, and a sheet discharge tray 29. In addition, the image forming portion 3 has a first drive portion 30 (see FIG. 2).

The image forming unit 21, the image forming unit 22, the image forming unit 23, and the image forming unit 24 are electrophotographic image forming units that correspond to Y (yellow), C (cyan), M (magenta), and K (black), respectively. As illustrated in FIG. 1, the image forming units 21 to 24 are arranged side by side along the front-rear direction D2 of the image forming apparatus 100 in the order of yellow, cyan, magenta, and black from the front of the image forming apparatus 100.

Figure 3:
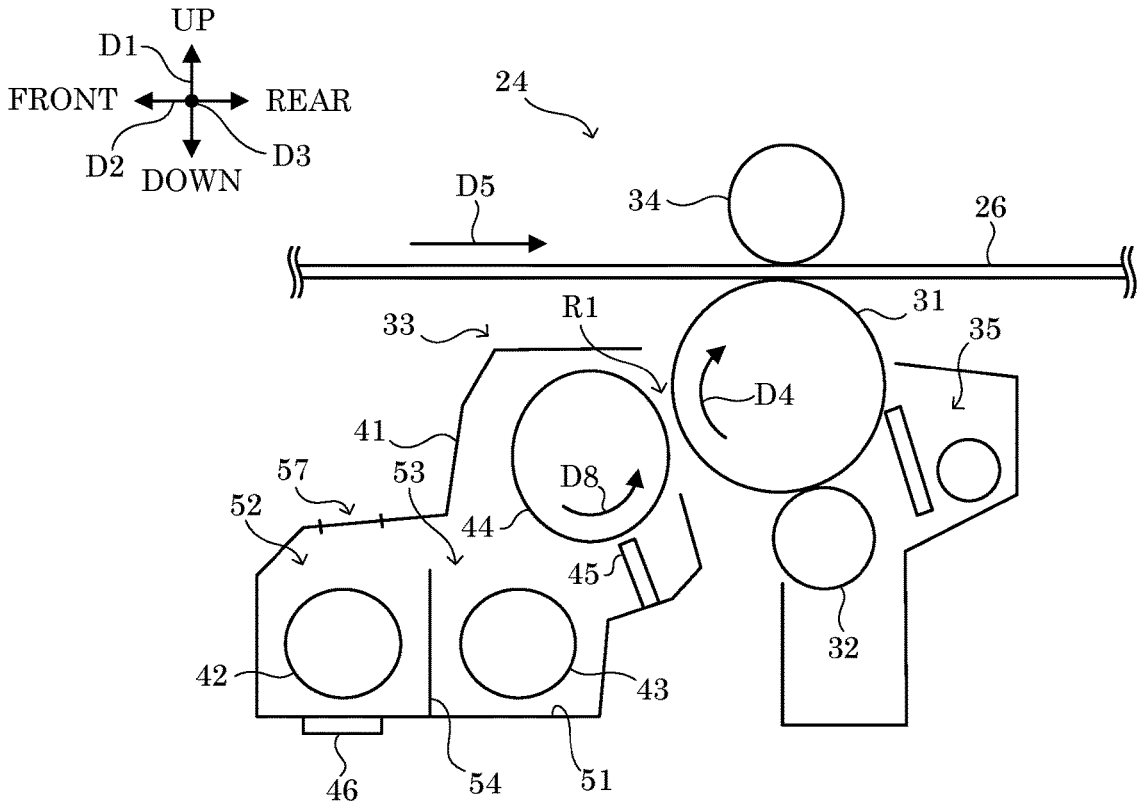
FIG. 3 is a drawing illustrating a configuration of an image forming unit of the image forming apparatus according to the embodiment of the present disclosure.

As illustrated in FIG. 3, the image forming unit 24 includes a photoconductor drum 31, a charging roller 32, a developing portion 33, a primary transfer roller 34, and a drum cleaning member 35. The image forming units 21 to 23 each have the same configuration as the image forming unit 24.

The photoconductor drum 31 carries a toner image. The photoconductor drum 31 receives a rotational drive power supplied from the first drive portion 30 and is rotated in a rotation direction D4 illustrated in FIG. 3.

The charging roller 32 charges a surface of the photoconductor drum 31. A light emitted from the laser scanning unit 25 based on the image data is irradiated on the surface of the photoconductor drum 31 charged by the charging roller 32. Thus, an electrostatic latent image is formed on the surface of the photoconductor drum 31.

The developing portion 33 uses a non-magnetic toner to develop the electrostatic latent image formed on the surface of the photoconductor drum 31. The toner is an example of the developer of the present disclosure. Accordingly, the toner image is formed on the surface of the photoconductor drum 31.

The primary transfer roller 34 transfers the toner image formed on the surface of the photoconductor drum 31 by the developing portion 33, to the intermediate transfer belt 26.

The drum cleaning member 35 removes the toner remaining on the surface of the photoconductor drum 31 after the primary transfer roller 34 transfers the toner image.

The laser scanning unit 25 emits light based on image data toward the surface of the photoconductor drum 31 in each of the image forming units 21 to 24.

The intermediate transfer belt 26 is an endless belt member to which the toner image formed on the surface of the photoconductor drum 31 in each of the image forming units 21 to 24 is transferred. The intermediate transfer belt 26 is stretched with a predetermined tension by a drive roller and a tension roller. The intermediate transfer belt 26 is rotated in a rotation direction D5 illustrated in FIG. 3 when the drive roller is rotated in response to a rotational driving force supplied from the first drive portion 30.

The secondary transfer roller 27 transfers the toner image transferred on the surface of the intermediate transfer belt 26 to a sheet fed from the sheet feed portion 4.

The fixing device 28 fixes the toner image transferred on the sheet by the secondary transfer roller 27, onto such sheet.

The sheet onto which the fixing device 28 fixes the toner image is discharged to the sheet discharge tray 29.

The first drive portion 30 serves as a motor that supplies the rotational driving force to the photoconductor drum 31 in each of the image forming units 21 to 24, the developing portion 33, and the intermediate transfer belt 26.

Configuration of Developing Portion 33

Figure 4:
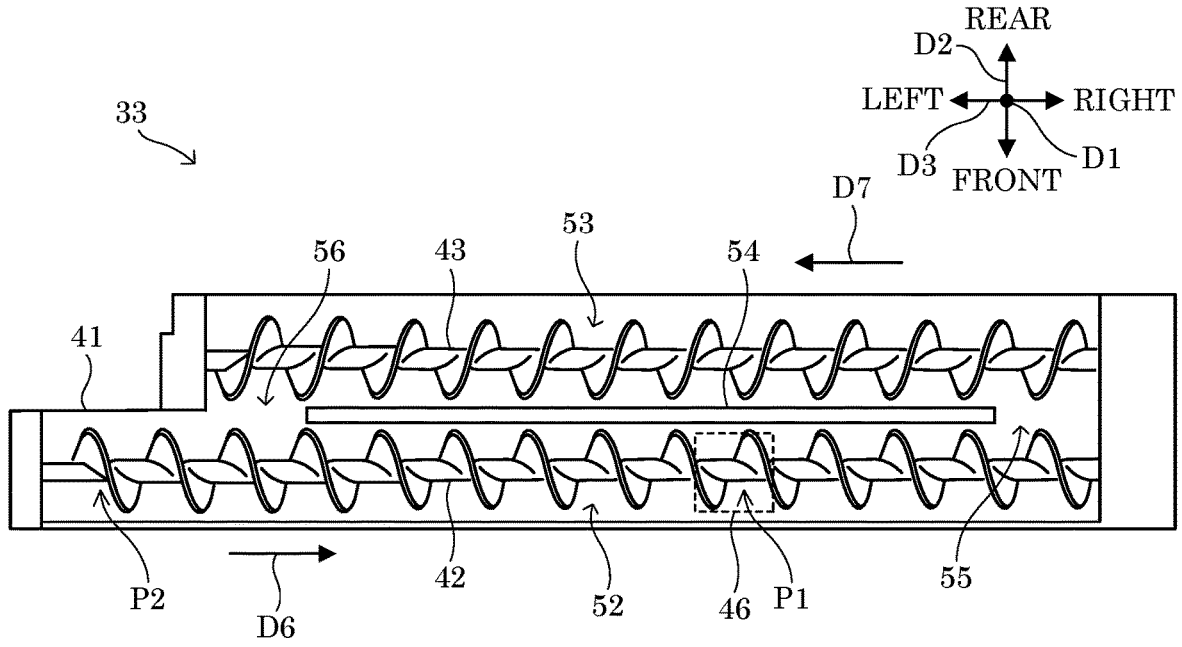
FIG. 4 is a drawing illustrating a configuration of a developing portion of the image forming apparatus according to the embodiment of the present disclosure.

Next, a configuration of the developing portion 33 in the image forming unit 24 will be described with reference to FIG. 3 and FIG. 4. Here, FIG. 4 is a drawing of a first conveyance path 52 and a second conveyance path 53 as seen from above. The image forming units 21 to 23 each have the same configuration of that of the developing portion 33 which will be described.

As illustrated in FIG. 3 and FIG. 4, the developing portion 33 has a housing 41, a first conveyance member 42, a second conveyance member 43, a developing roller 44, a regulating member 45, and a toner sensor 46. The developing portion 33 also has a toner container 47 (see FIG. 1), and a second drive portion 48 (see FIG. 2). FIG. 2 illustrates the toner sensor 46 corresponding to the image forming unit 24, and the second drive portion 48.

The housing 41 accommodates the first conveyance member 42, the second conveyance member 43, the developing roller 44, and the regulating member 45. In addition, the housing 41 accommodates a two-component developer containing the toner and the magnetic carrier. The housing 41 is an example of a storage portion of the present disclosure. The housing 41 is elongated along the left-right direction D3. The housing 41 accommodates the toner and the carrier within an internal space defined by a bottom surface 51 (see FIG. 3) and side walls.

As illustrated in FIG. 3 and FIG. 4, the housing 41 has the first conveyance path 52 and the second conveyance path 53 through which the toner and the carrier are conveyed. Specifically, the bottom surface 51 of the housing 41 has a partition wall 54 extending along the left-right direction D3 (see FIG. 4). The bottom surface 51, the side walls, and the partition wall 54 of the housing 41 form the first conveyance path 52 and the second conveyance path 53 extending along the left-right direction D3.

The first conveyance member 42 is rotatably provided in the housing 41. As illustrated in FIG. 4, the first conveyance member 42 is provided in the first conveyance path 52. The first conveyance member 42 conveys, along a conveyance direction D6 illustrated in FIG. 4, the toner and the carrier accommodated in the first conveyance path 52. In addition, the first conveyance member 42 stirs the toner and the carrier and allows the toner and the carrier to be frictionally charged. The first conveyance member 42 is an example of a conveying portion of the present disclosure. For example, the first conveyance member 42 is a screw-shaped member capable of rotating around a rotation axis along the left-right direction D3 in the first conveyance path 52. The first conveyance member 42 is rotated in response to rotational driving force supplied from the first drive portion 30. The first conveyance member 42 is not limited to the screw-shaped member, but may be a member capable of stirring and conveying the toner and the carrier.

The second conveyance member 43 is rotatably provided in the housing 41. As illustrated in FIG. 4, the second conveyance member 43 is provided in the second conveyance path 53. The second conveyance member 43 conveys, along a conveyance direction D7 illustrated in FIG. 4, the toner and the carrier accommodated in the second conveyance path 53. In addition, the second conveyance member 43 stirs the toner and the carrier and allows the toner and the carrier to be frictionally charged. For example, the second conveyance member 43 is a screw-shaped member capable of rotating around a rotation axis along the left-right direction D3 in the second conveyance path 53. The second conveyance member 43 is rotated in response to the rotational driving force supplied from the first drive portion 30.

A first passage 55 leading to the second conveyance path 53 is formed at a downstream end of the conveyance direction D6 in the first conveyance path 52. The first passage 55 is defined by the side walls and a right end portion of the partition wall 54 of the housing 41. In addition, a second passage 56 leading to the first conveyance path 52 is formed at a downstream end of the conveyance direction D7 in the second conveyance path 53. The second passage 56 is defined by the side walls and a left end portion of the partition wall 54 of the housing 41. That is, the housing 41 has, in its inside, a circulation conveyance path through which the toner and the carrier circulate, the circulation conveyance path defined by the first conveyance path 52, the first passage 55, the second conveyance path 53, and the second passage 56.

The developing roller 44 uses the toner to develop the electrostatic latent image formed on the photoconductor drum 31. As illustrated in FIG. 3, the developing roller 44 is provided so as to face the second conveyance member 43 and the photoconductor drum 31. The developing roller 44 is rotatably supported by the housing 41, and is rotated along a rotation direction D8 (see FIG. 3) in response to the rotational driving force supplied from the first drive portion 30. The developing roller 44 scoops the toner and the carrier from the second conveyance path 53. The toner and the carrier scooped by the developing roller 44 form a magnetic brush on an outer circumference surface of the developing roller 44 by magnetic force of magnetic poles provided inside the developing roller 44. The developing roller 44 conveys the magnetic brush formed on the outer circumference surface to a facing area R1 (see FIG. 3) where the developing roller 44 and the photoconductor drum 31 face each other, and allows the toner contained in the magnetic brush to be moved toward the surface of the photoconductor drum 31. Accordingly, the electrostatic latent image formed on the photoconductor drum 31 can be developed.

The regulating member 45 regulates a layer thickness of the magnetic brush formed on the outer circumference surface of developing roller 44. As illustrated in FIG. 3, the regulating member 45 is disposed downstream of a facing area where the second conveyance member 43 and the developing roller 44 face each other in the rotation direction D8, and disposed upstream of the facing area R1 where the developing roller 44 and the photoconductor drum 31 face each other in the rotation direction D8. The regulating member 45 faces the outer circumference surface of the developing roller 44 so as to form a predetermined gap between the regulating member 45 and the outer circumference surface of the developing roller 44.

The toner sensor 46 outputs an electrical signal in accordance with magnetic permeability at a detection position P1 (see FIG. 4) in the conveyance path through which the toner and the carrier conveyed by the first conveyance member 42 passes. The toner sensor 46 is an example of a sensor of the present disclosure. As illustrated in FIG. 3, the toner sensor 46 is disposed on a bottom surface portion of the housing 41. For example, the toner sensor 46 outputs a voltage in accordance with the magnetic permeability at the detection position P1. For example, the voltage outputted from the toner sensor 46 decreases as the amount of the toner at the detection position P1 increases. The toner sensor 46 is used to detect a storage amount of the toner in the developing portion 33.

The toner container 47 stores the toner of K (black). The toner container 47 has a container main body, a supply port portion, and a conveyance member 47A (see FIG. 1). The container main body is elongated along the left-right direction D3, and stores the toner. The supply port portion is formed at a left end portion of the container main body. The supply port portion is opened downward. The supply port portion is connected to an opening portion 57 (see FIG. 3) formed on the upper surface of the housing 41 through a supply path (not illustrated) extending in the vertical direction.

The opening portion 57 is opened, on an upper surface portion of the housing 41, toward a supply position P2 (see FIG. 4) that is positioned upward of the detection position P1 in the conveyance path through which the toner and the carrier conveyed by the first conveyance member 42 passes. As illustrated in FIG. 4, the supply position P2 is a position at a left end portion of the first conveyance path 52.

The conveyance member 47A supplies the toner from the toner container 47 to the supply position P2 (see FIG. 4) in the housing 41. The conveyance member 47A is rotatable around a rotational axis along the left-right direction D3 inside the toner container 47, and conveys the amount of the toner in accordance with rotation number toward the supply port portion. For example, the conveyance member 47A is a screw-shaped member capable of conveying the toner inside the toner container 47 toward the left direction. The toner conveyed to the supply port portion by the conveyance member 47A passes through the supply path by weight of the toner and falls to the supply position P2 of the housing 41. That is, the conveyance member 47A can supply the amount of toner in accordance with the rotation number toward the supply position P2 of the housing 41.

The second drive portion 48 supplies driving force to the conveyance member 47A. For example, the second drive portion 48 is a motor. The conveyance member 47A is rotated in response to rotational driving force supplied from the second drive portion 48.

Along with an increase in the rotation speed of the first conveyance member 42, the amount of carrier scooped by the first conveyance member 42 increases and a density of the carrier at the detection position P1 decreases. Accordingly, the output of the toner sensor 46 changes regardless of whether a storage amount of the toner in the housing 41 has changed. Therefore, in a configuration in which the rotation speed of the first conveyance member 42 is changeable, detection accuracy of the storage amount of toner in the housing 41 is degraded. On the other hand, focusing on a fact that there is a relationship expressed by a linear expression between the rotation speed of the first conveyance member 42 and an output value of the toner sensor 46, an image forming apparatus configured to correct the output value of the toner sensor 46 based on the rotation speed of the first conveyance member 42 has been known.

However, there is a limit to the decrease in the density of the carrier at the detection position P1 along with the increase in the rotation speed of the first conveyance member 42. When such limit is exceeded, the density of the carrier at the detection position P1 hardly decreases even when the rotation speed of the first conveyance member 42 increases. That is, when the rotation speed of the first conveyance member 42 exceeds a limit value, the relationship between the rotation speed of the first conveyance member 42 and the output value of the toner sensor 46 changes. Such change is not taken into consideration in the above-described image forming apparatus. Therefore, the storage amount of toner cannot be accurately detected.

Figure 6:
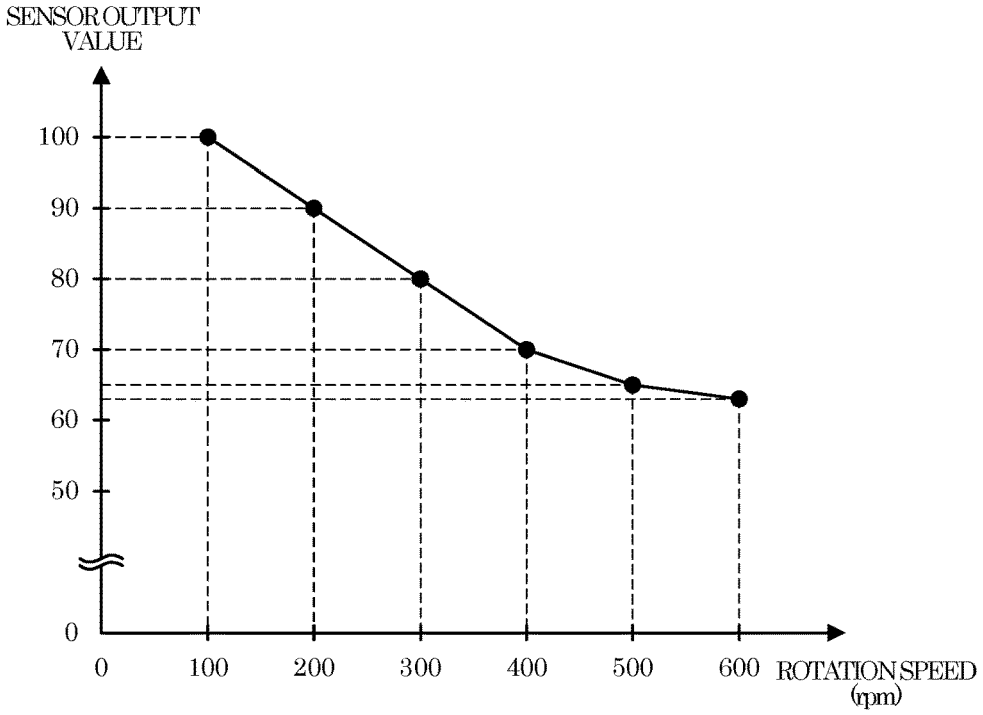
FIG. 6 is a drawing illustrating a relationship between an electrical signal outputted from a toner sensor and a rotation speed of a first conveyance member, in the image forming apparatus according to the embodiment of the present disclosure.

FIG. 6 illustrates an example of the relationship between the rotation speed of the first conveyance member 42 and the output value of the toner sensor 46. FIG. 6 plots the output value of the toner sensor 46 when the rotation speed of the first conveyance member 42 is a multiple of 100 rpm. In FIG. 6, the output value of the toner sensor 46 is indicated as an 8-bit digital value.

As illustrated in FIG. 6, in a range from 100 rpm to 400 rpm of the rotation speed of the first conveyance member 42, it is recognized that there is a relationship expressed by the linear expression between the rotation speed of the first conveyance member 42 and the output value of the toner sensor 46. On the other hand, when the rotation speed of the first conveyance member 42 substantially exceeds 400 rpm, the relationship between the rotation speed of the first conveyance member 42 and the output value of the toner sensor 46 changes. In this example, it is conceived that the decrease in the density of the carrier reaches its limit when the rotation speed of the first conveyance member 42 substantially exceeds 400 rpm. The rotation speed of the first conveyance member 42 (hereinafter referred to as a "limit speed") at which the decrease in the density of the carrier reaches its limit changes depending on factors such as temperature and humidity inside the housing 41 and the storage amount of the toner in the housing 41.

On the other hand, in the image forming apparatus 100 according to the embodiment of the present disclosure, it is possible to improve the detection accuracy of the storage amount of the toner in the housing 41 as described below.

Specifically, in the image forming apparatus 100, it is determined whether the rotation speed of the first conveyance member 42 exceeds the limit speed based on a fluctuation width of the electrical signal outputted from the toner sensor 46 during a rotation period of the first conveyance member 42. The fluctuation width is a difference between a maximum value and a minimum value of the electrical signal outputted from the toner sensor 46 during the rotation period of the first conveyance member 42. Then, a method for correcting the output value of the toner sensor 46 is switched in accordance with a determination result.

Figure 7:
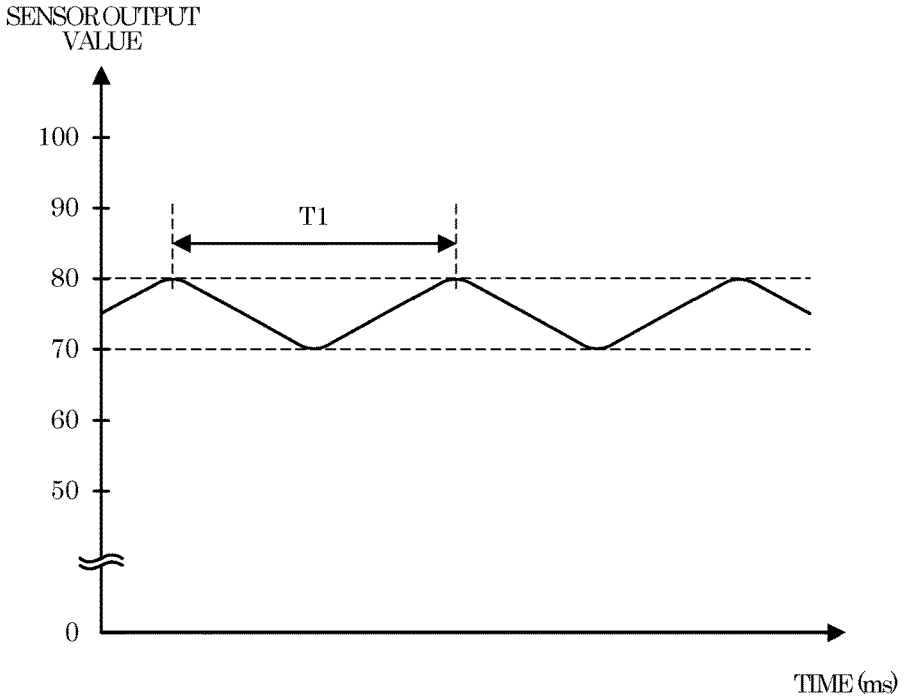
FIG. 7 is a drawing illustrating a transition of the electrical signal outputted from the toner sensor in the image forming apparatus according to the embodiment of the present disclosure.
Figure 8:
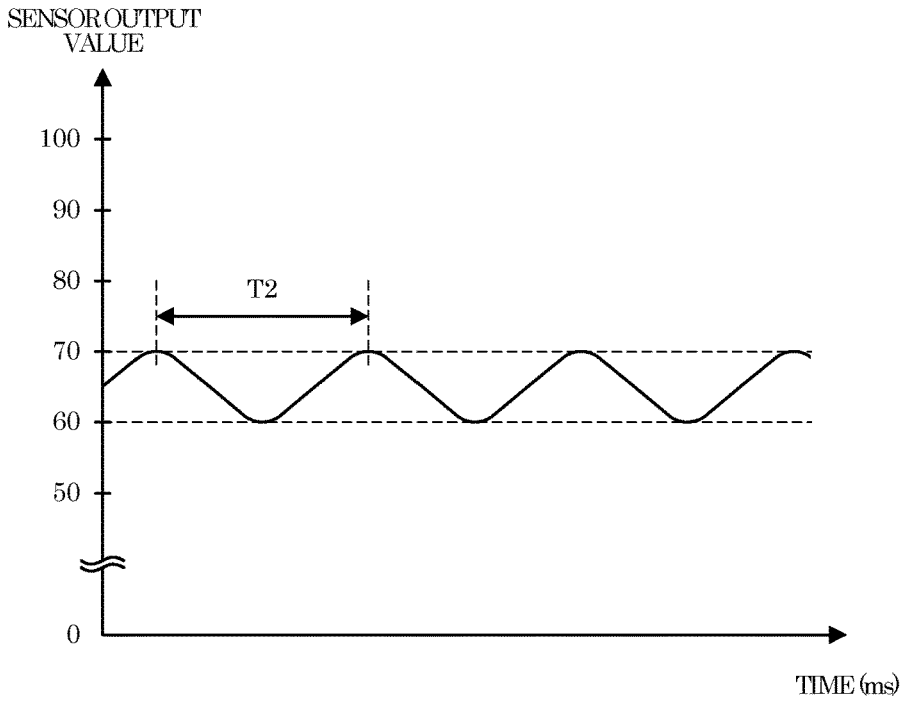
FIG. 8 is a drawing illustrating a transition of the electrical signal outputted from the toner sensor in the image forming apparatus according to the embodiment of the present disclosure.
Figure 9:
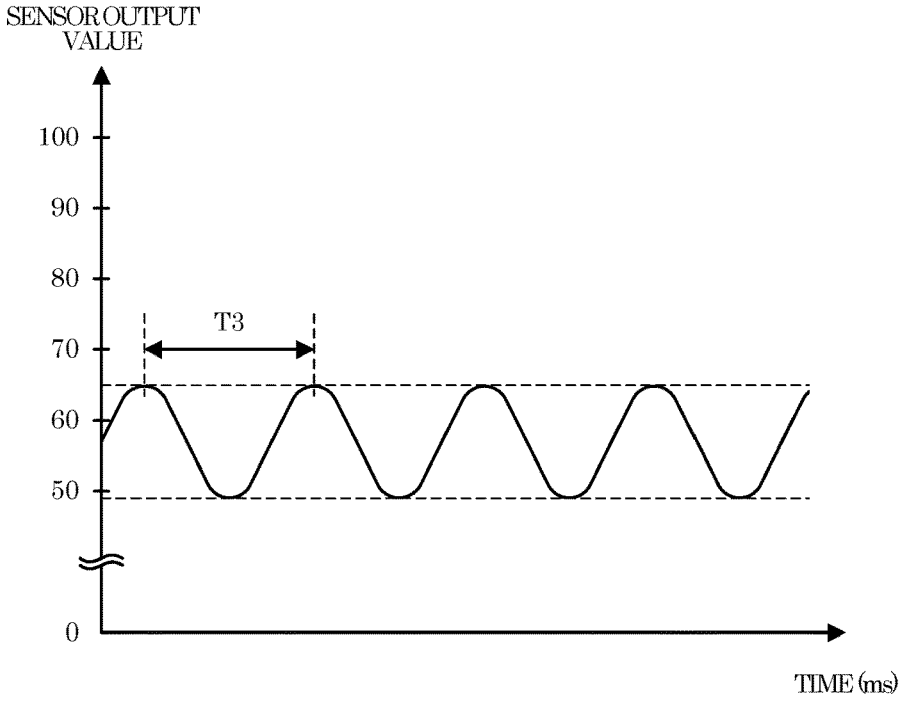
FIG. 9 is a drawing illustrating a transition of the electrical signal outputted from the toner sensor in the image forming apparatus according to the embodiment of the present disclosure.
Figure 10:
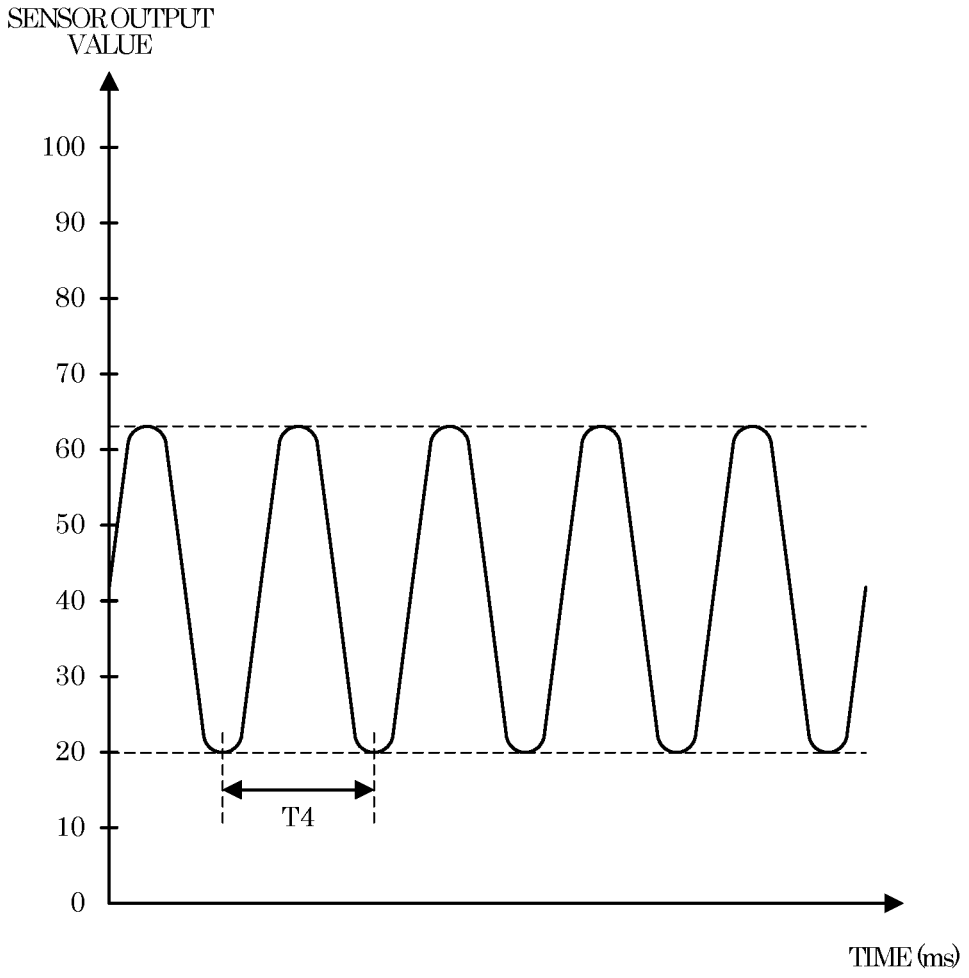
FIG. 10 is a drawing illustrating a transition of the electrical signal outputted from the toner sensor in the image forming apparatus according to the embodiment of the present disclosure.

Here, FIG. 7 illustrates an example of a transition of the output value outputted from the toner sensor 46 during a rotation period T1 of the first conveyance member 42 when the rotation speed of the first conveyance member 42 is 300 rpm. In addition, FIG. 8 illustrates an example of a transition of the output value outputted from the toner sensor 46 during a rotation period T2 of the first conveyance member 42 when the rotation speed of the first conveyance member 42 is 400 rpm. In addition, FIG. 9 illustrates an example of a transition of the output value outputted from the toner sensor 46 during a rotation period T3 of the first conveyance member 42 when the rotation speed of the first conveyance member 42 is 500 rpm. In addition, FIG. 10 illustrates an example of a transition of the output value outputted from the toner sensor 46 during a rotation period T4 of the first conveyance member 42 when the rotation speed of the first conveyance member 42 is 600 rpm. FIG. 6 plots the maximum value outputted from the toner sensor 46 during the rotation period of the first conveyance member 42 when the rotation speed of the first conveyance member 42 is a multiple of 100 rpm.

As illustrated in FIG. 6 to FIG. 8, when the rotation speed of the first conveyance member 42 is less than or equal to the limit speed, the fluctuation width does not change regardless of the increase in the rotation speed of the first conveyance member 42. On the other hand, as illustrated in FIG. 6, FIG. 9 and FIG. 10, when the rotation speed of the first conveyance member 42 exceeds the limit speed, the fluctuation width increases in accordance with the rotation speed of the first conveyance member 42. That is, it can be determined, based on the fluctuation width, whether the rotation speed of the first conveyance member 42 exceeds the limit speed. In addition, it is possible to determine, based on the fluctuation width, a difference between the rotation speed of the first conveyance member 42 and the limit speed when the rotation speed of the first conveyance member 42 exceeds the limit speed.

Configuration of Control Portion 7

Hereinafter, the control portion 7 that corrects the output value of the toner sensor 46 will be described with reference to FIG. 2.

As illustrated in FIG. 2, the control portion 7 includes a drive control portion 61, an acquisition processing portion 62, a correction processing portion 63, and an output processing portion 64. A device including the developing portion 33, the acquisition processing portion 62, the correction processing portion 63, and the output processing portion 64 is an example of a developing device of the present disclosure.

Specifically, the ROM 12 of the control portion 7 prestores a developer detection program for causing the CPU 11 of the control portion 7 to execute a developer detection process (see a flowchart in FIG. 5) which will be described later. The CPU 11 of the control portion 7 functions as the drive control portion 61, the acquisition processing portion 62, the correction processing portion 63, and the output processing portion 64 by executing the developer detection program stored in the ROM 12.

The developer detection program is recorded in a computer-readable recording medium such as CD, DVD, flash memory or the like, and may be read from the recording medium and stored in a storage device such as the storage portion 6. In addition, the drive control portion 61, the acquisition processing portion 62, the correction processing portion 63, and the output processing portion 64 may be composed of electronic circuits.

Hereinafter, in the image forming units 21 to 24, each component included in the image forming unit 24 will be described as examples. The following description applies to each of the image forming units 21 to 23 as well.

The drive control portion 61 drives the first drive portion 30 at a predetermined specific drive speed when print processing for forming the image on the sheet by using the image forming portion 3 is performed.

Here, the specific drive speed is a drive speed of the first drive portion 30 corresponding to a specific print speed set as an execution speed of the print processing by user's operation, among a plurality of predetermined print speeds. That is, in the image forming apparatus 100, the first drive portion 30 is driven at one of a plurality of drive speeds corresponding to the plurality of print speeds. In addition, the first conveyance member 42 is driven at one of the plurality of rotation speeds corresponding to the plurality of drive speeds of the first drive portion 30. For example, the first conveyance member 42 is rotated at one of the rotation speeds of 100 rpm, 200 rpm, 300 rpm, 400 rpm, 500 rpm, and 600 rpm (see FIG. 6).

The acquisition processing portion 62 acquires a specific value based on the electrical signal that is outputted from the toner sensor 46 during the rotation period of the first conveyance member 42.

Here, the specific value corresponds to a maximum value of the electrical signal that is outputted from the toner sensor 46 during the rotation period of the first conveyance member 42.

The specific value may correspond to a minimum value of the electrical signal that is outputted from the toner sensor 46 during the rotation period of the first conveyance member 42. Alternately, the specific value may correspond to an average value of the electrical signal that is outputted from the toner sensor 46 during the rotation period of the first conveyance member 42.

When the fluctuation width of the electrical signal that is outputted from the toner sensor 46 during the rotation period of the first conveyance member 42 is less than a predetermined threshold, the correction processing portion 63 executes a first correction process that is predetermined. Specifically, the first correction process corresponds to a process of correcting the specific value based on the rotation speed of the first conveyance member 42.

In addition, when the fluctuation width is equal to or greater than the threshold, the correction processing portion 63 executes a second correction process different from the first correction process. Specifically, the second correction process corresponds to a process of correcting the specific value based on the rotation speed of the first conveyance member 42 and the fluctuation width.

Here, the threshold is determined based on the fluctuation width when the rotation speed of the first conveyance member 42 is less than or equal to the limit speed. For example, the threshold is a value obtained by multiplying the fluctuation width when the rotation speed of the first conveyance member 42 is less than or equal to the limit speed by a predetermined coefficient such as 1.2. The threshold is simply required to be preset at a time of shipment of the image forming apparatus 100. In addition, the threshold may be set each time a predetermined set timing arrives. For example, the control portion 7 may be set based on the fluctuation width of the electrical signal outputted from the toner sensor 46 at the slowest rotation speed of the first conveyance member 42. The set timing is simply required to be a timing at which the image forming apparatus 100 is turned on, or a timing at which the number of cumulative printed sheets in the image forming apparatus 100 has reached a multiple of a predetermined standard number of sheets.

For example, in the first correction process, the specific value is corrected based on the following formula (1). A reference speed included in the formula (1) is one of the rotation speeds without requiring correction of the output value of the toner sensor 46, among the plurality of rotation speeds of the first conveyance member 42 corresponding to the plurality of printing speeds. In addition, a first correction coefficient included in the formula (1) is a predetermined value based on the relationship between the rotation speed of the first conveyance member 42 and the output value of the toner sensor 46 as illustrated in FIG. 6. Specifically, the first correction coefficient is a value corresponding to inclination of a linear approximate formula that expresses the relationship between the rotation speed of the first conveyance member 42 and the output value of the toner sensor 46 when the rotation speed of the first conveyance member 42 is less than or equal to the limit speed (see FIG. 6).

The specific value after correction=the specific value before correction−(the current rotation speed of the first conveyance member 42−the reference speed)×the first correction coefficient (1)

In addition, in the second correction process, the specific value is corrected based on the following formula (2). A second correction coefficient included in the formula (2) is a predetermined value based on the relationship between the rotation speed of the first conveyance member 42 and the output value of the toner sensor 46 as illustrated in FIG. 6. The second correction process may be a process of correcting the specific value by using a formula different from the formula (2).

The specific value after correction=the specific value before correction−(the current rotation speed of the first conveyance member 42−the reference speed)×the first correction coefficient+(the fluctuation width of the electrical signal of the toner sensor 46)×the second correction coefficient (2)

The output processing portion 64 outputs the specific value corrected by the correction processing portion 63. The specific value after correction outputted by the output processing portion 64 is inputted to an internal processor of the control portion 7 that executes a processing based on the specific value. In addition to the control portion 7, when a main control portion for comprehensively controlling the image forming apparatus 100 is provided, the specific value after correction outputted by the output processing portion 64 may be inputted to the main control portion or may be stored in a register provided in the control portion 7.

For example, the specific value after correction outputted by the output processing portion 64 is used for a control in which the toner is supplied to the developing portion 33 and a control of execution of the print processing. For example, in the image forming apparatus 100, when the specific value after correction outputted by the output processing portion 64 is equal to or higher than a predetermined first reference value, the toner is supplied from the toner container 47 to the developing portion 33. In addition, in the image forming apparatus 100, when the specific value after correction outputted by the output processing portion 64 is equal to or higher than a second reference value that is higher than the first reference value, toner empty is detected and execution of the print processing is restricted.

Figure 5:
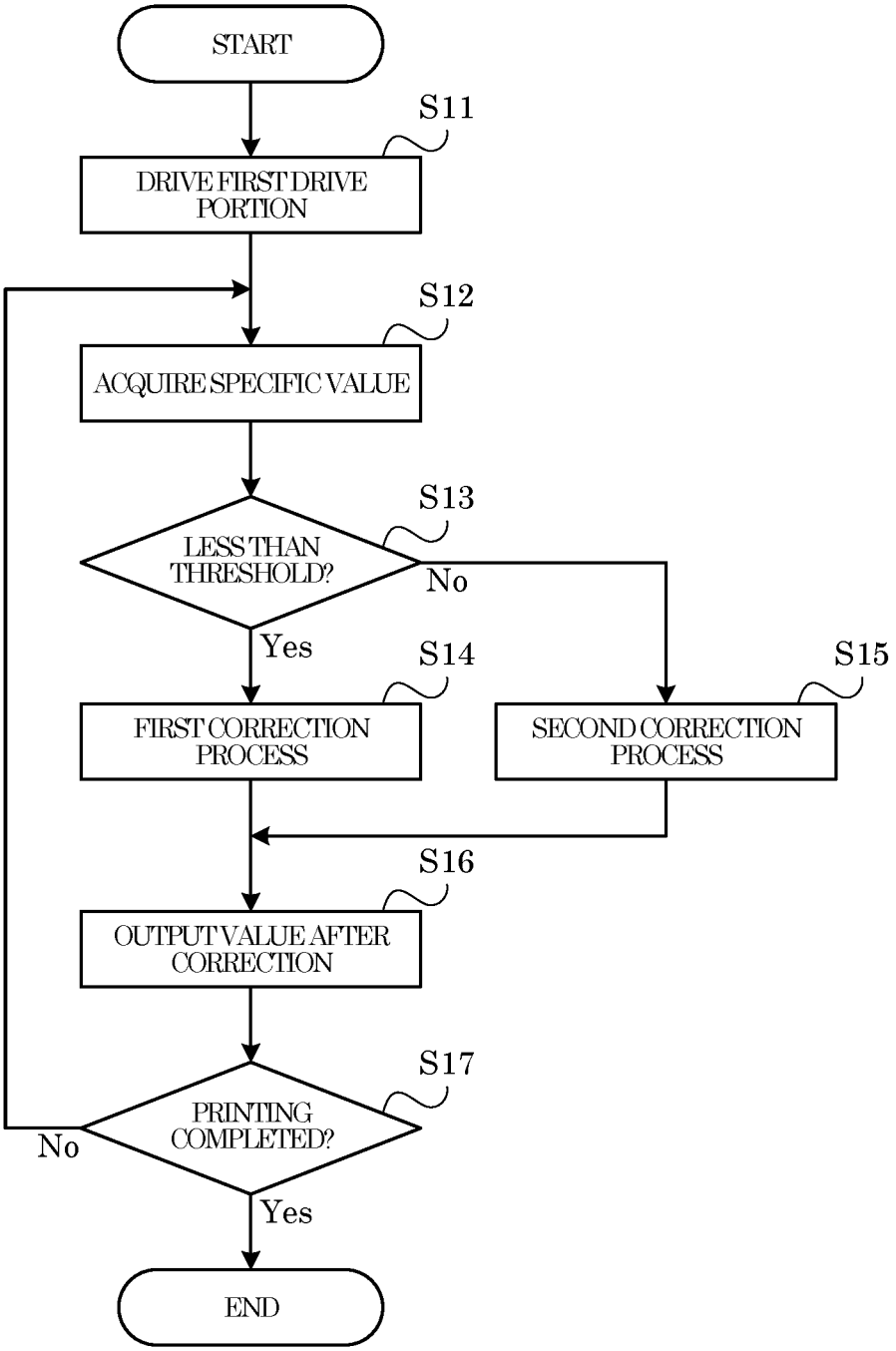
FIG. 5 is a flowchart illustrating one example of a developer detection process executed in the image forming apparatus according to the embodiment of the present disclosure.

Developer Detection Process Hereinafter, a developer detection method of the present disclosure will be described with reference to FIG. 5, together with an example of a procedure of a developer detection process executed by the control portion 7 in the image forming apparatus 100. Here, steps S11, S12 . . . each represent a reference number for a processing step executed by the control portion 7. The developer detection process is executed when an execution instruction of the print processing is inputted.

<Step S11>

Firstly, in a step S11, the control portion 7 causes the first drive portion 30 to be driven at the specific drive speed. Here, a processing of the step S11 is executed by the drive control portion 61 of the control portion 7. Accordingly, the developing portion 33 is supplied with driving force of the first drive portion 30, and the first conveyance member 42 is rotated at a rotation speed corresponding to the specific drive speed.

<Step S12>

In a step S12, the control portion 7 acquires the specific value based on the electrical signal outputted from the toner sensor 46 during the rotation period of the first conveyance member 42. Here, a processing of the step S12 is an example of the acquisition step of the present disclosure and is executed by the acquisition processing portion 62 of the control portion 7.

<Step S13>

In a step S13, the control portion 7 determines whether the fluctuation width of the electrical signal outputted from the toner sensor 46 during the rotation period of the first conveyance member 42 is less than the threshold.

Here, the control portion 7 switches a subsequent processing depending on a determination result of whether the fluctuation width is less than the threshold. Specifically, the control portion 7 determines that the fluctuation width is less than the threshold (Yes in the step S13), the control portion 7 causes the processing to move to a step S14. Alternately, when the control portion 7 determines that the fluctuation width is equal to or greater than the threshold (No in the step S13), the control portion 7 causes the processing to move to a step S15.

<Step S14>

In the step S14, the control portion 7 executes the first correction process. Here, the processing of the step S14 is an example of a correction step of the present disclosure and is executed by the correction processing portion 63 of the control portion 7.

<Step S15>

In the step S15, the control portion 7 executes the second correction process. Here, the processing of the step S15 is an example of the correction step of the present disclosure and is executed by the correction processing portion 63 of the control portion 7.

<Step S16>

In a step S16, the control portion 7 outputs the specific value corrected in the step S14 or the step S15. Here, a processing of a step S16 is executed by the output processing portion 64 of the control portion 7.

<Step S17>

In a step S17, the control portion 7 determines whether the print processing is completed.

Here, the control portion 7 switches a subsequent processing depending on a determination result of whether the print processing is completed. Specifically, when the control portion 7 determines that the print processing is completed (Yes in the step S17), the control portion 7 causes the developer detection process to be terminated. Alternately, when the control portion 7 determines that the print processing is not completed (No in the step S17), the control portion 7 causes the processing to move to the step S12. In this case, the control portion 7 repeatedly executes the processes from the step S12 to step S16 until it is determined that the print processing is completed. Accordingly, even when the limit speed changes during execution of the print processing due to changes in temperature and humidity in the housing 41 and changes in the storage amount of the toner in the housing 41, the storage amount of the toner can be accurately detected.

As such, in the image forming apparatus 100, it is determined whether the rotation speed of the first conveyance member 42 exceeds the limit speed, based on the fluctuation width of the electrical signal outputted from the toner sensor 46 during the rotation period of the first conveyance member 42. The correction method of the output value of the toner sensor 46 is switched in accordance with the determination result. Specifically, when the fluctuation width is less than the threshold, the specific value is corrected based on the rotation speed of the first conveyance member 42. In addition, when the fluctuation width is equal to or greater than the threshold, the specific value is corrected based on the rotation speed of the first conveyance member 42 and the fluctuation width. Accordingly, detection accuracy of the storage amount of the toner in the housing 41 can be improved, as compared with a configuration in which the output value of the toner sensor 46 is corrected based on the rotation speed of the first conveyance member 42 without determining whether the rotation speed of the first conveyance member 42 exceeds the limit speed.

The housing 41 may store a single component developer without containing the carrier. In this case, the toner may have a magnetic material.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a storage portion that stores a developer;

a conveying portion that is rotatably provided in the storage portion, the conveying portion stirring and conveying the developer within the storage portion;

a sensor that outputs an electrical signal in accordance with magnetic permeability at a predetermined detection position in a conveyance path of the developer conveyed by the conveying portion;

an acquisition processing portion configured to acquire a specific value based on the electrical signal outputted during a rotation period of the conveying portion; and a correction processing portion configured to correct the specific value based on a rotation speed of the conveying portion when a fluctuation width of the electrical signal outputted during the rotation period of the conveying portion is less than a predetermined threshold, and configured to correct the specific value based on the rotation speed of the conveying portion and the fluctuation width when the fluctuation width is equal to or greater than the threshold.

2. The developing device according to claim 1, wherein the conveying portion is a screw-shaped member.

3. The developing device according to claim 1, wherein the developer is a non-magnetic toner, and the storage portion stores the toner and a magnetic carrier.

4. The developing device according to claim 1, wherein the specific value is a maximum or minimum value of the electrical signal outputted during the rotation period of the conveying portion.

5. An image forming apparatus including the developing device according to claim 1.

6. A developer detection method executed in a developing device, the developing device comprising:

a storage portion that stores a developer;

a conveying portion that is rotatably provided in the storage portion, the conveying portion stirring and conveying the developer in the storage portion; and a sensor configured to output an electrical signal in accordance with magnetic permeability at a predetermined detection position in a conveyance path of the developer conveyed by the conveying portion, wherein the developer detection method includes:

an acquisition step of acquiring a specific value based on the electrical signal outputted during a rotation period of the conveying portion;

a correction step of correcting the specific value based on a rotation speed of the conveying portion when a fluctuation width of the electrical signal outputted during the rotation period of the conveying portion is less than a predetermined threshold, the correction step of correcting the specific value based on the rotation speed of the conveying portion and the fluctuation width when the fluctuation width is equal to or greater than the threshold.

* * * * *